US007920111B2

(12) United States Patent
Abdulaev et al.

(10) Patent No.: US 7,920,111 B2
(45) Date of Patent: Apr. 5, 2011

(54) LED-BASED OPTICAL SYSTEM AND METHOD OF COMPENSATING FOR AGING THEREOF

(75) Inventors: Rustam Abdulaev, Suwon-si (KR); Hoon Choi, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 982 days.

(21) Appl. No.: 11/697,992

(22) Filed: Apr. 9, 2007

(65) Prior Publication Data

US 2008/0077363 A1 Mar. 27, 2008

(30) Foreign Application Priority Data

Sep. 26, 2006 (KR) ..... 10-2006-0093439

(51) Int. Cl.
*G09G 3/32* (2006.01)

(52) U.S. Cl. ..... 345/82; 345/83; 345/84; 362/236; 362/249.02; 362/612; 362/613

(58) Field of Classification Search ..... 345/76, 345/82, 83, 84; 315/169.3; 702/189; 362/236, 362/249.02, 612, 613; 349/61, 62, 68, 69; 40/544

See application file for complete search history.

(56) References Cited

U.S. PATENT DOCUMENTS 6,153,985 A * 11/2000 Grossman ..... 315/291
7,515,260 B2 * 4/2009 Hagler ..... 356/310
7,615,939 B2 * 11/2009 Halter ..... 315/307

FOREIGN PATENT DOCUMENTS

KR 2006-0043823 A 5/2006
WO 2005/116972 A1 12/2005

* cited by examiner

*Primary Examiner* — Abbas I Abdulselam
(74) *Attorney, Agent, or Firm* — Sughrue Mion, PLLC

(57) ABSTRACT

An LED-based optical system and a method of compensating for aging thereof are provided. The LED-based optical system includes LED blocks composed of a predetermined number of LEDs; a sensor which senses output values of the respective LED blocks; and a control block which generates compensation rates by comparing initial output values of the respective LED blocks in an initial state with comparison output values of the LED blocks sensed by the sensor at a comparison time point, and controls current being supplied to the respective LED blocks in accordance with the compensation rates.

31 Claims, 5 Drawing Sheets

LED-BASED OPTICAL SYSTEM AND METHOD OF COMPENSATING FOR AGING THEREOF

CROSS-REFERENCE TO RELATED APPLICATIONS

This application claims priority under 35 U.S.C. §119 of Korean Patent Application No. 2006-93439, filed Sep. 26, 2006, in the Korean Intellectual Property Office, the entire disclosure of which is incorporated herein by reference.

BACKGROUND OF THE INVENTION

1. Field of the Invention

Apparatuses and methods consistent with the present invention relate to a light emitting diode (LED)-based optical system and a method of compensating for aging thereof. More particularly, the present invention relates to an LED-based optical system and a method of compensating for aging thereof, which may ensure a uniform picture quality by compensating for the non-uniformity of outputs of LED blocks occurring due to the differences in aging speed among the respective LED blocks.

2. Description of the Related Art

Recently, LEDs have been used for the purpose of illumination, and the development of LEDs for use as a backlight is in full swing. LEDs generate light of a relatively narrow spectrum that is influenced by a band gap of the semiconductor material used. Specifically, through the combination of R (red), G (green), and B (blue) LEDs, a mixed light and a white light may be generated. During the generation of the mixed light and the white light, a shade difference induced by varying the mixing rates of respective color LEDs appears as a color variation to produce the mixed colors. Accordingly, in the case of producing a lighting fixture using LEDs, the mixing rates among the respective color LEDs should be kept constant.

The optical characteristics of an LED may permanently change according to its own characteristics and the surrounding environment, and this permanent change in optical characteristics is called aging or degeneration. The aging speed differs according to the characteristics of the respective LED, and is heightened when the temperature surrounding the LED becomes high or when a high power is supplied.

On the other hand, LEDs installed in a large-area display panel are grouped into LED blocks, and in one LED block, LEDs having similar output characteristics are arranged. Here, the output characteristics refer to the amounts of energy outputted from LEDs when the same amount of current is supplied thereto. By arranging LEDs having the similar output characteristics in one LED block, it is possible to control LED blocks in accordance with the output characteristics of the LEDs. Accordingly, the output differences which may occur among the respective LED blocks due to the differences in output characteristics of the LEDs may be prevented.

However, in the case of a large-area display panel, differences in temperature among the respective LED blocks may occur due to their respective positions, and the aging speed of an LED block arranged in a high-temperature area may be as much as twice as high than that of an LED block arranged in a low-temperature area.

If the differences in aging speed occur among the LED blocks as described above, the colors outputted from the respective LED blocks may differ although they are controlled to output the same color. Due to the color deviation among the LED blocks, partial color non-uniformity may occur in the whole display panel to decrease the picture quality and lead to a user's dissatisfaction.

Accordingly, a need exists for a compensation method capable of minimizing the non-uniformity of colors among the respective LED blocks occurring due to the differences in aging speed among the respective LED blocks.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above. Accordingly, an aspect of the present invention is to provide an LED-based optical system and a method of compensating for aging thereof, which can remove the non-uniformity of colors among respective LED blocks occurring due to the differences in aging speed among the respective LED blocks.

The foregoing and other aspects are substantially realized by providing an LED-based optical system, according to embodiments of the present invention, which comprises at least one LED block composed of a predetermined number of LEDs; a sensor which senses output values of the respective LED blocks; and a control block which generates specified compensation rates by comparing initial output values of the respective LED blocks in an initial state with comparison output values of the respective LED blocks sensed by the sensor at a comparison time point, and controls an amounts of current being supplied to the respective LED blocks in accordance with the compensation rates.

The control block may comprise an output variation rate calculation unit which outputs output variation rates which are rates of the initial output values to the comparison output values for the respective LED blocks, and a compensation rate calculation unit which extracts a maximum value among the output variation rates of the respective LED blocks, and calculates the compensation rates by dividing the output variation rates of the respective LED blocks by the maximum value.

The output variation rates may be calculated with respect to red (R), green (G), and blue (B) LED groups of different colors included in the respective LED blocks.

The control block may comprise an average calculation unit which calculates average output variation rates of the respective colors by averaging the output variation rates of the respective color LED groups.

The control block may further comprise a compensation judgment unit which judges whether output compensation for the color LED groups of the LED blocks is possible in accordance with differences between the average output variation rates of the respective colors and the output variation rates of the color LED groups of the LED blocks.

The compensation judgment unit may judge that the LED groups of the corresponding color have been damaged or a measurement error has occurred if the difference exceeds a threshold value, and thus, judge that the compensation is not feasible.

The compensation rate calculation unit may extract the maximum value for each color, and calculate the compensation rates by dividing the output variation rates of the color LED groups of the LED blocks by the maximum value.

The control block may further comprise a pulse width calculation unit which calculates pulse widths to be newly applied by multiplying pulse widths of pulse signals, which have been previously provided with respect to the color LED groups of the LED blocks whose compensation is judged to be possible, by the compensation rates.

The LED-based optical system may further comprise an LED driver which controls the operation of the color LED groups of the LED blocks, wherein the control block provides information on the calculated pulse widths to the LED driver, and the LED driver provides the pulse signals having the pulse widths to the color LED groups of the LED blocks.

The sensor may comprise R, G, and B sensors to sense outputs of the R, G, and B LED groups.

The R, G, and B sensors may be installed one by one.

The R, G, and B sensors may have adjustable sensitivities.

A plurality of sensor pairs of the R, G, and B sensors may be grouped and installed.

The R, G, and B sensors may have different sensitivities in the sensors of the same color.

A plurality of sensor pairs of the R, G, and B sensors may be installed at predetermined intervals.

The respective sensor pairs may have the same sensitivity.

When the initial output values or the comparison output values of the LED blocks are sensed, the respective LED blocks are sensed one by one by alternately turning on the respective LED blocks.

When the initial output values or the comparison output values of the LED blocks are sensed, the R, G, and B LED groups included in the LED blocks are alternately turned on.

When the initial output values or the comparison output values of the LED blocks are sensed, the R, G, and B LED groups included in the LED blocks are turned on at a time.

According to another aspect of the present invention, there is provided a method of compensating for aging of an LED-based optical system, which comprises generating initial output values of at least one LED block composed of a predetermined number of LEDs in an initial state with respect to the respective LED blocks; generating comparison output values of the respective LED blocks by sensing the output values of the respective LED blocks at a comparison time point; generating specified compensation rates by comparing the initial output values with the comparison output values of the respective LED blocks; and compensating for outputs of the respective LED blocks in accordance with the compensation rates.

BRIEF DESCRIPTION OF THE DRAWINGS

The above aspects and features of the present invention will become more apparent by describing certain exemplary embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Figure 1:
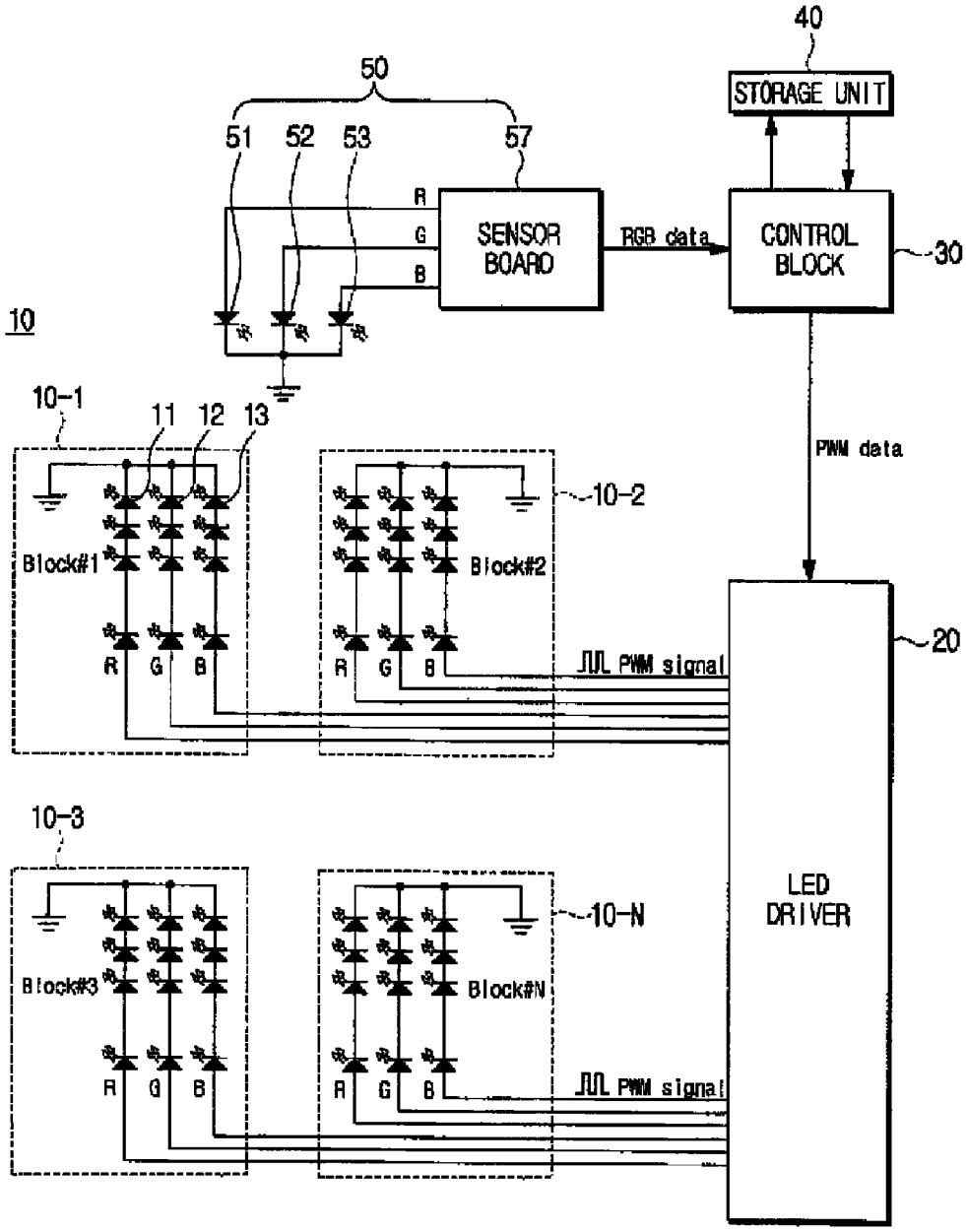
FIG. 1 is a block diagram illustrating the construction of a backlight adopting an LED-based optical system according to an exemplary embodiment of the present invention.

Exemplary embodiments of the present invention will now be described in detail with reference to the annexed drawings. In the drawings, the same elements are denoted by the same reference numerals throughout the drawings. In the following description, detailed descriptions of known functions and configurations incorporated herein have been omitted for conciseness and clarity.

FIG. 1 is a block diagram illustrating the construction of a backlight adopting an LED-based optical system according to an exemplary embodiment of the present invention.

Referring to FIG. 1, a backlight comprises a plurality of LED blocks 10-1 to 10-N, an LED driver 20, an red, green and blue (RGB) sensor 50, a control block 30, and a storage unit 40.

The backlight is composed of the plurality of LED blocks 10-1 to 10-N, and each LED block includes a plurality R, G, and B LEDs. Here, the R LEDs are connected in series to constitute an R LED group 11, the G LEDs are connected in series to constitute a G LED group 12, and the B LEDs are connected in series to constitute a B LED group 13. The R LED group 11, G LED group 12, and B LED group 13 are connected in parallel, and receive pulse signals from the LED driver 20 connected thereto.

The LED driver 20 is connected to one or a plurality of LED blocks 10-1 to 10-N. That is, the LED driver 20 may be connected to all LED blocks 10-1 to 10-N that constitute one backlight, or to a part 10 of the LED blocks. The LED driver 20, under the control of the control block 30, controls pulse widths of pulse signals for determining amounts of current supplied to the R LED group 11, G LED group 12, and B LED group 13 of the LED blocks 10-1 to 10-N. As the pulse width of the pulse signal is widened, i.e., the duty rate of the pulse signal becomes larger, the amount of current supplied to the respective LED groups 11, 12, and 13 is increased.

The RGB sensor 50 comprises R, G, and B sensors 51, 52, and 53 for sensing energy outputted from the R, G, and B LED groups 11, 12, and 13, and a sensor board 57 for generating output values of the R, G, and B LED groups 11, 12, and 13 by processing the energy sensed by the respective sensors 51, 52, and 53 as data. Here, the respective sensors 51, 52, and 53 may comprise photodiodes.

For convenience sake in assembling or for other design reasons, the sensors 51, 52 and 53 may be installed one by one in the backlight, or alternatively, a plurality of sensor pairs of the R, G, and B sensors 51, 52, and 53 may be installed at predetermined intervals. Additionally, the sensors 51, 52 and 53 may be installed on one side of the backlight.

Figure 2A:
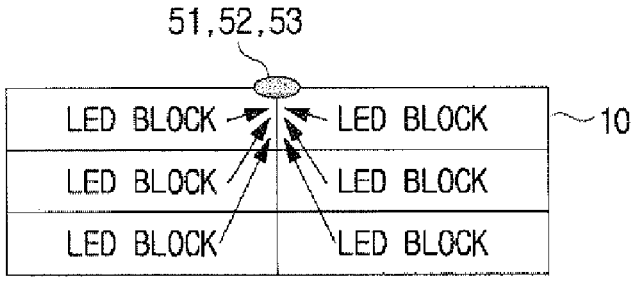
FIGS. 2A and 2B are views schematically illustrating a backlight in which respective sensor positions are indicated according to an exemplary embodiment of the present invention.

In FIG. 2A, a backlight composed of 6 LED blocks 10 is illustrated. The respective sensors 51, 52, and 53 are installed between a pair of LED blocks 10 arranged on the upper part of the backlight. Although a single group of sensors is illustrated in FIG. 2A, pairs of groups of sensors 51, 52, and 53 may also be installed in corresponding positions.

In the case where one group of sensors 51, 52, and 53 are installed, the sensors 51, 52, and 53 may be configured to have adjustable sensitivities since the sensors 51, 52, and 53 are sensing the outputs of the LED blocks 10 located at difference distances from the sensors. That is, in the case of sensing the output of the LED block 10 arranged adjacent to the sensor group 51, 52, and 53, the sensitivity of the R, G, and B sensors 51, 52, and 53 is adjusted to be decreased, while in the case of sensing the output of the LED block 10 arranged apart from the sensor group 51, 52, and 53, the sensitivity of the R, G, and B sensors 51, 52, and 53 is adjusted to be increased, so that the outputs of the LED blocks 10 can be sensed uniformly.

In the case where a plurality of groups of the sensors 51, 52, and 53 are installed, the respective sensor groups 51, 52, and 53 may be provided with different sensitivities, and the sensor groups 51, 52, and 53 for sensing the outputs correspond to the respective LED blocks 10, so that the outputs of the LED blocks 10 can be sensed.

Figure 2B:
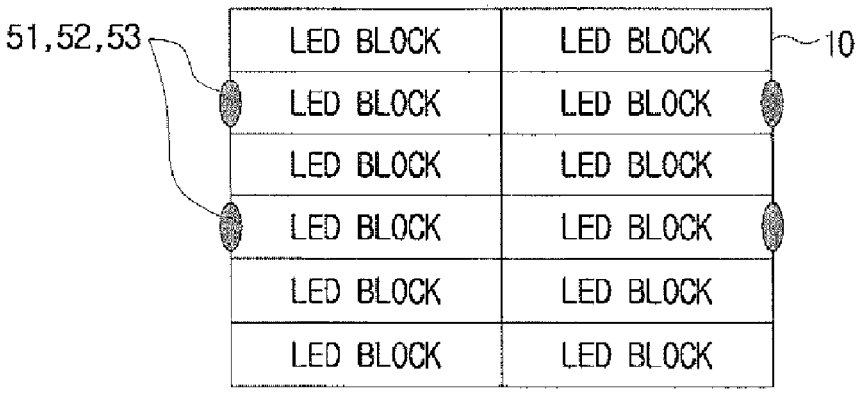

In FIG. 2B, a backlight composed of N blocks is illustrated, and the respective sensor groups 51, 52, and 53 are installed at predetermined intervals. Accordingly, the respective sensor groups 51, 52, and 53 sense the outputs of one or more LED blocks 10 arranged adjacent thereto. At this time, since the distances between the respective sensor groups 51, 52, and 53 and the respective LED blocks 10 are almost the same, the respective sensor groups 51, 52, and 53 may be configured to have the same sensitivity.

On the other hand, irrespective of the case that one sensor group 51, 52, 53 is installed, or a plurality of sensor groups 51, 52, and 53, are installed in a single place or dispersedly installed, the outputs of the respective LED blocks 10 can be detected by respectively or simultaneously turning on the R, G, and B LED groups 11, 12, and 13 of the LED blocks.

That is, the R, G, and B sensors 51, 52, and 53 may sequentially sense the outputs of the R, G, and B LED groups 11, 12, and 13 by sequentially turning on the R, G, and B LED groups 11, 12, and 13 for each LED block 10. Also, by simultaneously turning on the R, G, and B LED groups 11, 12, and 13 included in one LED block 10, the R, G, and B sensors 51, 52, and 53 may simultaneously sense the outputs of the R, G, and B LED groups 11, 12, and 13. In the latter case, the time required for the respective sensors 51, 52, and 53 to sense the outputs may be reduced.

The control block 30 generates specified compensation rates by comparing initial output values ($R'_x$, $G'_x$, $B'_x$) sensed from the RGB sensor 50 in an initial state with comparison output values ($R_x$,$G_x$,$B_x$) at a comparison time point, and compensates the output by adjusting the amounts of current supplied to the respective color LED groups 11, 12, and 13 included in the LED blocks 10-1 to 10-N.

Figure 3:
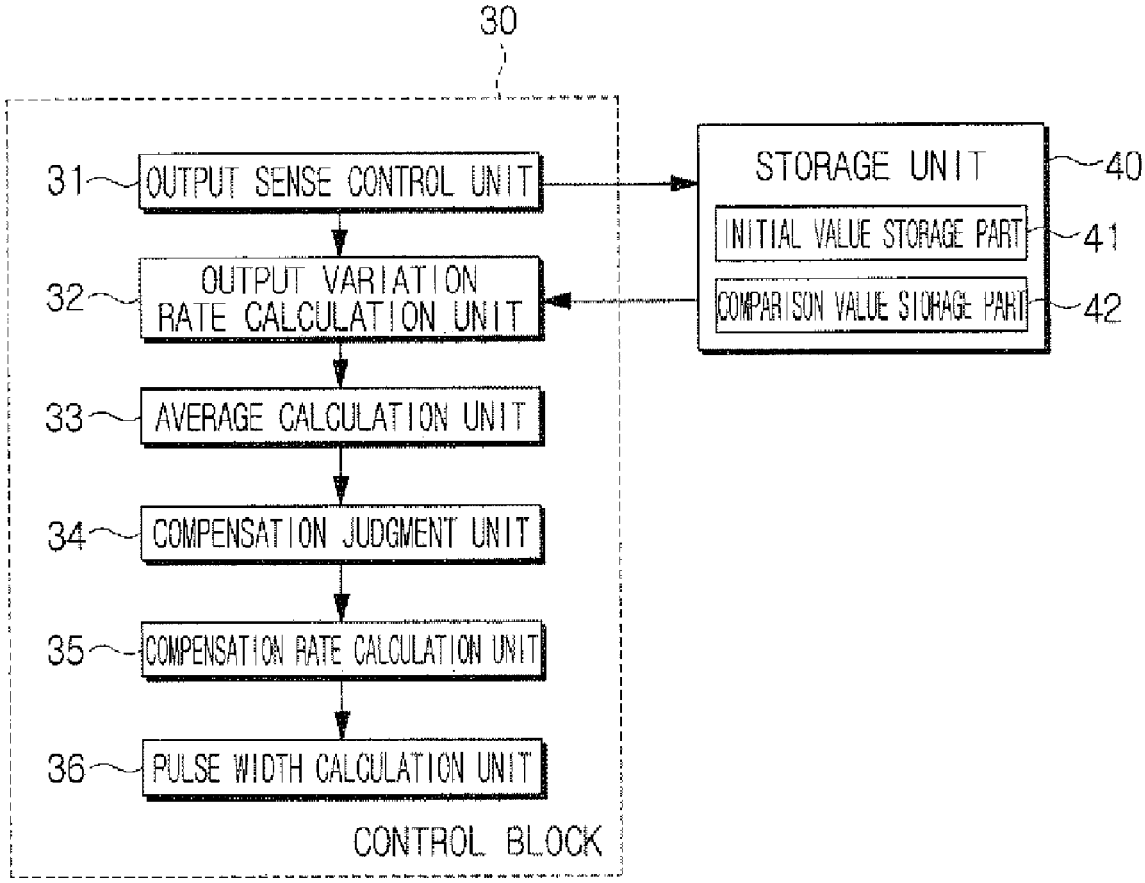
FIG. 3 is a block diagram illustrating the detailed construction of a control block of an LED-based optical system according to an exemplary embodiment of the present invention.

As shown in FIG. 3, the control block 30 comprises an output sense control unit 31, an output variation rate calculation unit 32, an average calculation unit 33, a compensation judgment unit 34, a compensation rate calculation unit 35, and a pulse width calculation unit 36.

The output sense control unit 31 controls the output sensing operation of the color LED groups 11, 12, and 13 of the LED blocks 10-1 to 10-N, and stores the output values of the color LED groups 11, 12, and 13 of the LED blocks 10-1 to 10-N sensed by the RGB sensor 50 in the storage unit 40. In this case, the initial output values ($R'_x$,$G'_x$,$B'_x$) and the comparison output values ($R_x$,$G_x$,$B_x$) are stored in the storage unit 40. The initial output values ($R'_x$,$G'_x$,$B'_x$) are values sensed from the color LED groups 11, 12, and 13 of the LED blocks 10-1 to 10-N in the initial state such as when a backlight product is tested or when the power is initially applied, and the comparison output values ($R_x$,$G_x$,$B_x$) are values sensed from the color LED groups 11, 12, and 13 of the LED blocks 10-1 to 10-N at a certain comparison time point.

The storage unit 40 may be a memory device such as an electronically erasable programmable read-only memory (EEPROM) or a flash memory, and comprises an initial value storage part 41 for storing the initial output values ($R'_x$,$G'_x$, $B'_x$) and a comparison value storage part 42 for storing the comparison output values ($R_x$,$G_x$,$B_x$). Here, the initial value storage part 41 and the comparison value storage part 42 have different addresses.

The output sense control unit 31 stores the initial output values ($R'_x$,$G'_x$,$B'_x$) and the comparison output values ($R_x$,$G_x$, $B_x$) in the initial value storage part 41 and the comparison value storage part 42, respectively, through a process to be described later with reference to FIG. 4.

The output variation rate calculation unit 32 calculates the output variation rates $$\left(\frac{R'_x}{R_x}, \frac{G'_x}{G_x}, \frac{B'_x}{B_x}\right),$$

which are the rates of the initial output values ($R'_x$,$G'_x$,$B'_x$) stored in the storage unit 40 to the comparison output values ($R_x$,$G_x$,$B_x$), with respect to the LED blocks 10-1 to 10-N. The output variation rates $$\left(\frac{R'_x}{R_x}, \frac{G'_x}{G_x}, \frac{B'_x}{B_x}\right)$$

are obtained by dividing the initial output values ($R'_x$,$G'_x$,$B'_x$) by the comparison output values ($R_x$,$G_x$,$B_x$). In this case, the output variation rate calculation unit 32 calculates the respective output variation rates $$\left(\frac{R'_x}{R_x}, \frac{G'_x}{G_x}, \frac{B'_x}{B_x}\right)$$

of the R, G, and B LED groups 11, 12, and 13 of different colors included in the LED blocks 10-1 to 10-N.

Accordingly, 3*N output variation rates $$\left(\frac{R'_x}{R_x}, \frac{G'_x}{G_x}, \frac{B'_x}{B_x}\right)$$

are generated with respect to the R, G, and B LED groups 11, 12, and 13 of N LED blocks 10-1 to 10-N. Here, the output variation rate $$\left(\frac{R'_x}{R_x}\right)$$

of the R LED group 11 of the first LED block 10-1 is expressed as $R_1'/R_1$, the output variation rate $$\left(\frac{G'_x}{G_x}\right)$$

of the G LED group 12 is expressed as $G_1'/G_1$, and the output variation rate $$\left(\frac{B'_x}{B_x}\right)$$

of the B LED group 13 is expressed as $B_1'/B_1$. In the same manner, the output variation rate $$\left(\frac{R_x'}{R_x}\right)$$

of the R LED group 11 of the N-th LED block 10-N is expressed as $R_N'/R_N$, the output variation rate $$\left(\frac{G_x'}{G_x}\right)$$

of the G LED group 12 is expressed as $G_N'/G_N$, and the output variation rate $$\left(\frac{B_x'}{B_x}\right)$$

of the B LED group 13 is expressed as $B_N'/B_N$.

The average calculation unit 33 calculates average output variation rates of the respective color LED groups 11, 12, and 13 by averaging the output variation rates $$\left(\frac{R_x'}{R_x}, \frac{G_x'}{G_x}, \frac{B_x'}{B_x}\right)$$

of the R, G, and B LED groups 11, 12, and 13 included in all the LED blocks 10-1 to 10-N. That is, as shown in Equation (1), the average calculation unit 33 calculates the average output variation rate $R_{mean}$ of the R LED group 11 by adding the output variation rates $$\left(\frac{R_x'}{R_x}\right)$$

of the R LED groups 11 included in all the LED blocks 10-1 to 10-N and dividing the added output variation rate by N, that is, the number of LED blocks 10-1 to 10-N. In the same manner, the average calculation unit 33 calculates the average output variation rate $G_{mean}$ of the G LED groups 12 and the average output variation rate $B_{mean}$ of the B LED groups 13. Accordingly, three average output variation rates ($R_{mean}$, $G_{mean}$, $B_{mean}$) are calculated for the respective colors by the average calculation unit 33.

$$R_{mean} = \frac{\sum_{x=1}^{N} \frac{R_x'}{R_x}}{N} \quad (1)$$

$$G_{mean} = \frac{\sum_{x=1}^{N} \frac{G_x'}{G_x}}{N}$$

$$B_{mean} = \frac{\sum_{x=1}^{N} \frac{B_x'}{B_x}}{N}$$

The compensation judgment unit 34, as shown in Equation (2), judges whether the compensation for the color LED groups 11, 12, and 13 of the LED blocks 10-1 to 10-N is possible by comparing differences between the respective average output variation rates ($R_{mean}$, $G_{mean}$, $B_{mean}$) of the R, G, and B LED groups 13 and the output variation rates $$\left(\frac{R_x'}{R_x}, \frac{G_x'}{G_x}, \frac{B_x'}{B_x}\right)$$

of the color LED groups 11, 12, and 13 of the LED blocks 10-1 to 10-N, with compensation range values ($FaultRange_R$, $FaultRange_G$, $FaultRange_B$) predetermined according to the colors.

$$R_{mean} - \frac{R_x'}{R_x} \le FaultRange_R \quad (2)$$

$$G_{mean} - \frac{G_x'}{G_x} \le FaultRange_G$$

$$B_{mean} - \frac{B_x'}{B_x} \le FaultRange_B$$

Here, x denotes the number of corresponding LED blocks 10-1 to 10-N, and this means that through Equation (2), whether the compensation is possible is judged with respect to all the color LED groups 11, 12, and 13 of all the LED blocks 10-1 to 10-N. That is, whether the compensation is possible is judged with respect to 3*N color LED groups 11, 12, and 13.

The compensation judgment unit 34 judges that full compensation is impossible if the differences between the output variation rates $$\left(\frac{R_x'}{R_x}, \frac{G_x'}{G_x}, \frac{B_x'}{B_x}\right)$$

of the color LED groups 11, 12, and 13 of the LED blocks 10-1 to 10-N and the average output variation rates ($R_{mean}$, $G_{mean}$, $B_{mean}$) of the color LED groups 11, 12, and 13 exceed the compensation range values, while it judges that full compensation is possible if the differences are within the compensation range values. This is because if the differences are larger than the compensation range values, it is considered that LEDs included in the corresponding color LED groups 11, 12, and 13 of the LED blocks 10-1 to 10-N may have been damaged or a measurement error may have occurred. Accordingly, the compensation range values are determined as the differences between the average output variation rates ($R_{mean}$, $G_{mean}$, $B_{mean}$), which can be calculated on the assumption that the LEDs are not damaged or the measurement error has not occurred, and the output variation rates $$\left(\frac{R_x'}{R_x}, \frac{G_x'}{G_x}, \frac{B_x'}{B_x}\right).$$

The compensation rate calculation unit 35 calculates compensation rates ($r_x$,$g_x$,$b_x$) with respect to the color LED groups 11, 12, and 13 of the LED blocks 10-1 to 10-N of which full compensation is judged to be possible. For this, as shown in Equation (3), the compensation rate calculation unit 35 extracts the maximum values $$\left(\frac{R'_{MAX}}{R_{MAX}}, \frac{G'_{MAX}}{G_{MAX}}, \frac{B'_{MAX}}{B_{MAX}}\right)$$

among the output variation rates $$\left(\frac{R'_x}{R_x}, \frac{G'_x}{G_x}, \frac{B'_x}{B_x}\right)$$

of the color LED groups 11, 12, and 13 of the LED blocks 10-1 to 10-N, and calculates the compensation rates ($r_x$,$g_x$,$b_x$) by dividing the output variation rates $$\left(\frac{R'_x}{R_x}, \frac{G'_x}{G_x}, \frac{B'_x}{B_x}\right)$$

of the color LED groups 11, 12, and 13 of the LED blocks 10-1 to 10-N by the maximum values $$\left(\frac{R'_{MAX}}{R_{MAX}}, \frac{G'_{MAX}}{G_{MAX}}, \frac{B'_{MAX}}{B_{MAX}}\right).$$

$$r_x = \frac{\left(\frac{R'_x}{R_x}\right)}{\left(\frac{R'_{MAX}}{R_{MAX}}\right)} \quad (3)$$

$$g_x = \frac{\left(\frac{G'_x}{G_x}\right)}{\left(\frac{G'_{MAX}}{G_{MAX}}\right)}$$

$$b_x = \frac{\left(\frac{B'_x}{B_x}\right)}{\left(\frac{B'_{MAX}}{B_{MAX}}\right)}$$

Here, the compensation rates are the rates of the relative output variation rates among the LED blocks 10-1 to 10-N, and have values that are smaller than or equal to "1" since they are obtained by dividing the output variation values $$\left(\frac{R'_x}{R_x}, \frac{G'_x}{G_x}, \frac{B'_x}{B_x}\right)$$

by the maximum values $$\left(\frac{R'_{MAX}}{R_{MAX}}, \frac{G'_{MAX}}{G_{MAX}}, \frac{B'_{MAX}}{B_{MAX}}\right).$$

Accordingly, in the corresponding color LED groups 11, 12, and 13 of the LED block 10-1 to 10-N, of which the output variation rates $$\left(\frac{R'_x}{R_x}, \frac{G'_x}{G_x}, \frac{B'_x}{B_x}\right)$$

are equal to the maximum values $$\left(\frac{R'_{MAX}}{R_{MAX}}, \frac{G'_{MAX}}{G_{MAX}}, \frac{B'_{MAX}}{B_{MAX}}\right),$$

the compensation rates ($r_x$,$g_x$,$b_x$) become "1", while in the corresponding color LED groups 11, 12, and 13 of the LED block 10-1 to 10-N, of which the output variation rates $$\left(\frac{R'_x}{R_x}, \frac{G'_x}{G_x}, \frac{B'_x}{B_x}\right)$$

are smaller than the maximum values $$\left(\frac{R'_{MAX}}{R_{MAX}}, \frac{G'_{MAX}}{G_{MAX}}, \frac{B'_{MAX}}{B_{MAX}}\right),$$

the compensation rates ($r_x$,$g_x$,$b_x$) become smaller than "1".

In this case, a larger amount of current than supplied to other LED blocks 10-1 to 10-N should be supplied to the corresponding color LED groups 11, 12, and 13 of the LED block 10-1 to 10-N of which the compensation rates ($r_x$,$g_x$,$b_x$) are "1". However, since the threshold values of the current amount supplied to the respective LEDs are fixed according to the characteristics of the LEDs, it is impossible to unlimitedly increase the amount of current. If the amount of current for the corresponding color LED groups 11, 12, and 13 of the LED block 10-1 to 10-N, of which the compensation is possible, is generally increased, the life span of the LEDs is shortened with the power consumption increased.

Accordingly, with respect to the corresponding LED groups 11, 12, and 13 of the LED block 10-1 to 10-N of which the compensation rates ($r_x$,$g_x$,$b_x$) are "1", the compensation is not performed, and the same amount of current as the previous one should be supplied. By contrast, with respect to the corresponding LED groups 11, 12, and 13 of the LED block 10-1 to 10-N of which the compensation rates ($r_x$,$g_x$,$b_x$) are smaller than "1", the compensation is performed, and the amount of current smaller than the current applied to those having a compensation rate of "1" may be supplied.

The pulse width calculation unit 36, according to Equation (4), calculates the pulse widths of pulse signals provided to the corresponding color LED groups 11, 12, and 13 of the LED block 10-1 to 10-N having the compensation rates ($r_x$, $g_x$,$b_x$).

$$PWMR_x = PWMR \times r_x$$

$$PWMG_x = PWMG \times g_x$$

$$PWMB_x = PWMB \times b_x \quad (4)$$

Here, PWMR, PWMG, and PWMB denote the pulse widths of the pulse signals provided to the color LED groups 11, 12, and 13 of the existing LED blocks 10-1 to 10-N, and $PWMR_x$, $PWMG_x$, and $PWMB_x$ are pulse widths of compensated pulse signals.

In this case, the pulse width calculation unit calculates the pulse widths of the pulse signals only when the compensation rates ($r_x$,$g_x$,$b_x$) calculated by the compensation rate calculation unit 35 are smaller than "1", and since the compensation rates ($r_x$,$g_x$,$b_x$) are smaller than "1", the pulse widths of the pulse signals become smaller than the existing ones. Specifically, in the case of the corresponding color LED groups 11, 12, and 13 of the LED block 10-1 to 10-N of which the output variation rates $$\left(\frac{R'_x}{R_x}, \frac{G'_x}{G_x}, \frac{B'_x}{B_x}\right)$$

reach the maximum values $$\left(\frac{R'_{MAX}}{R_{MAX}}, \frac{G'_{MAX}}{G_{MAX}}, \frac{B'_{MAX}}{B_{MAX}}\right)$$

and the compensation rates ($r_x$,$g_x$,$b_x$) become "1", the pulse signals having the same pulse widths as the existing ones are provided, while in the case of the corresponding color LED groups 11, 12, and 13 of the LED block 10-1 to 10-N of which the output variation rates $$\left(\frac{R'_x}{R_x}, \frac{G'_x}{G_x}, \frac{B'_x}{B_x}\right)$$

are smaller than the maximum values $$\left(\frac{R'_{MAX}}{R_{MAX}}, \frac{G'_{MAX}}{G_{MAX}}, \frac{B'_{MAX}}{B_{MAX}}\right)$$

and the compensation rates ($r_x$,$g_x$,$b_x$) become smaller than "1", the pulse signals having the pulse widths narrower than the existing ones are provided. As a result, in the case of the corresponding color LED groups 11, 12, and 13 of the LED block 10-1 to 10-N with the highest degree of aging, the same amount of current as the existing one is supplied, while in the case of the corresponding color LED groups 11, 12, and 13 of the LED block 10-1 to 10-N with less aging, the amount of current less than the existing one is supplied.

Accordingly, the amount of current being supplied to the corresponding color LED groups 11, 12, and 13 of the LED blocks 10-1 to 10-N is varied according to the degree of aging, and thus, compensation of the non-uniformity among the LED blocks 10-1 to 10-N due to the aging may be performed.

On the other hand, since the brightness of the backlight is adjusted on the basis of the corresponding color LED groups 11, 12, and 13 of the LED block 10-1 to 10-N having the highest degree of aging in the compensation process, the brightness of the backlight may be generally lowered. However, such lowered brightness of the backlight can be adjusted using the brightness adjustment function that is used in the existing monitors and so on.

The pulse width calculation unit 36 provides the calculated pulse widths of the pulse signals to the LED driver 20, and the LED driver 20 provides the pulse signals having the calculated pulse widths to the corresponding LED groups 11, 12, and 13 of the LED block.

Figure 4:
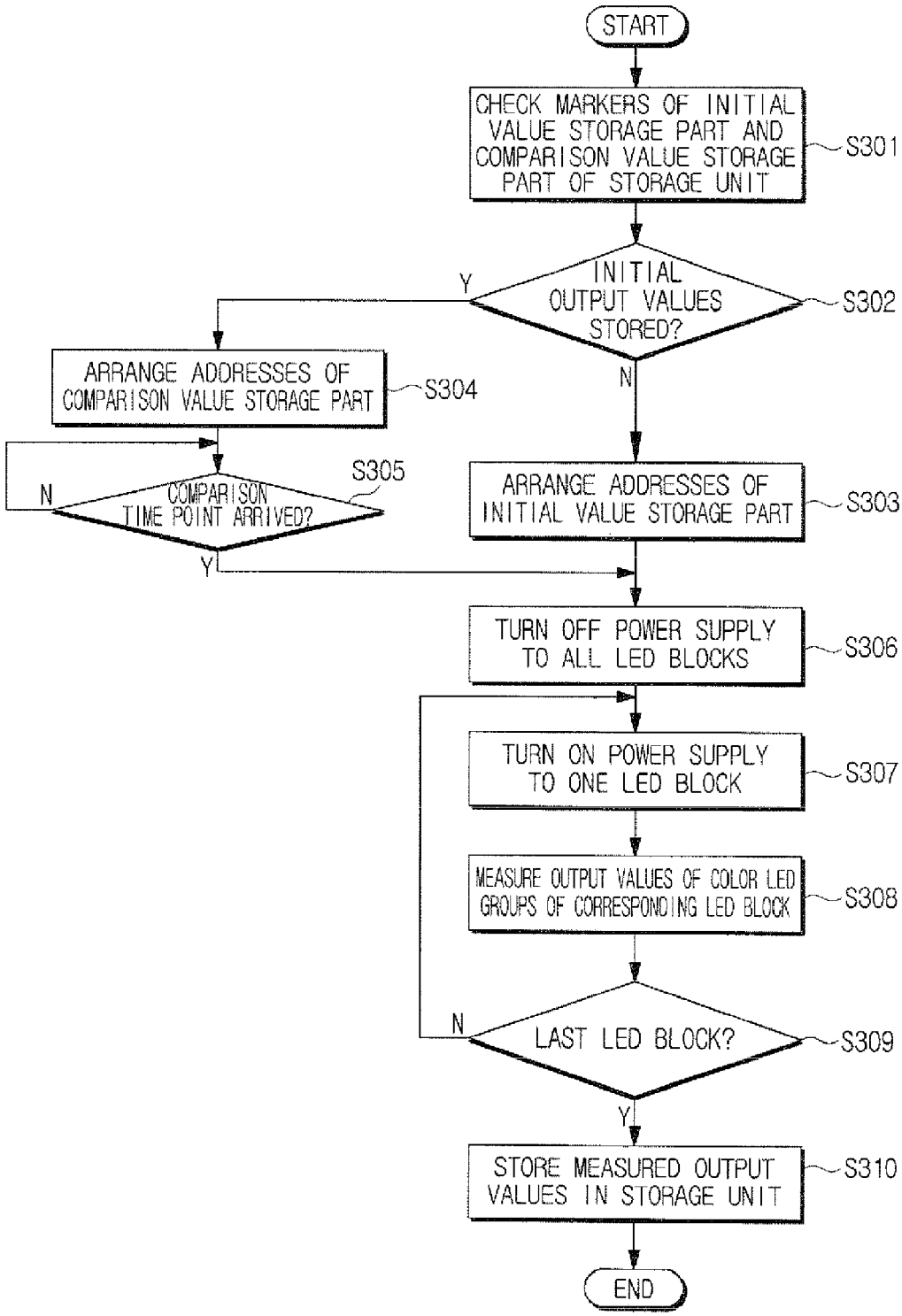
FIG. 4 is a flowchart illustrating a process of extracting initial output values and comparison output values through an output sense control unit of FIG. 3 according to an exemplary embodiment of the present invention.

FIG. 4 is a flowchart illustrating a process of extracting initial output values ($R'_x$,$G'_x$,$B'_x$) and comparison output values ($R_x$,$G_x$,$B_x$) through an output sense control unit of FIG. 3 according to an exemplary embodiment of the present invention.

First, the output sense control unit 31 checks markers of the initial value storage part 41 and the comparison value storage part 42 of the storage unit 40 in operation (S301), and confirms whether the initial output values ($R'_x$,$G'_x$,$B'_x$) are stored in operation (S302).

If the initial output values ($R'_x$,$G'_x$,$B'_x$) are not stored in the initial value storage part 41 (N in operation (S302)), the output sense control unit 31 arranges addresses of the initial value storage part 41 in a row in operation (S303). The arrangement of the addresses is to store the initial output values ($R'_x$,$G'_x$,$B'_x$) measured by the RGB sensor 50 in the initial state.

Then, the output sense control unit 31 turns off the power being supplied to all LED blocks 10-1 to 10-N to cut off the current in operation (S306), and alternately turns on the powers of the LED blocks 10-1 to 10-N in operation (S307). Then, the output sense control unit 31 measures the initial output values ($R'_x$,$G'_x$,$B'_x$) for the corresponding color LED groups 11, 12, and 13 of the LED block 10-1 using the RGB sensor 50 in operation (S308). The output sense control unit 31 confirms whether the initial output values ($R'_x$,$G'_x$,$B'_x$) are measured up to the last LED block 10-N in operation (S309), and if the initial output values ($R'_x$,$G'_x$,$B'_x$) are measured for all the LED blocks 10-1 to 10-N, it stores the measured initial output values ($R'_x$,$G'_x$,$B'_x$) of the LED blocks 10-1 to 10-N in the initial value storage part 41 of the storage unit 40 in operation (S310).

On the other hand, if the initial output values ($R'_x$,$G'_x$,$B'_x$) are stored (Y in operation (S302)), the output sense control unit 31 arranges the addresses of the comparison value storage part 42 in a row in operation (S304). Then, the output sense control unit 31 judges whether the comparison time point, at which the non-uniformity of outputs among the LED blocks 10-1 to 10-N is to be compensated for, has arrived in operation (S305).

If the comparison time point has arrived (Y in operation (S305)), the output sense control unit 31 turns off the power of all the LED blocks 10-1 to 10-N in operation (S306), and alternately turns on the respective LED blocks 10-1 to 10-N in operation (S307). The output sense control unit 31 then measures the comparison output values ($R_x$,$G_x$,$B_x$) of the color LED groups 11, 12, and 13 of the turned-on LED blocks 10-1 to 10-N in operation (S308).

In this case, the output sense control unit 31 can also measure the comparison output values ($R_x$,$G_x$,$B_x$) of the color LED groups 11, 12, and 13 in a state that it simultaneously turns on all the LED groups 11, 12, and 13 of the LED blocks 10-1 to 10-N to generate a white light.

If the comparison output values ($R_x$,$G_x$,$B_x$) are measured with respect to all the LED blocks 10-1 to 10-N as determined in operation (S309), the measured comparison output values ($R_x$,$G_x$,$B_x$) of the respective LED blocks 10-1 to 10-N are stored in the comparison value storage part 42 of the storage unit 40 in operation (S310).

The comparison time point for measuring the comparison output values ($R_x$,$G_x$,$B_x$) may be diversely set, such as whenever the backlight is turned on or whenever the turn-on time of the backlight elapses, or may be optionally selected by a user. In the case of measuring the comparison output values ($R_x$,$G_x$,$B_x$) after the measurement of the initial comparison output values ($R_x$,$G_x$,$B_x$), the above-described operation S305 to S310 are repeated.

Hereinafter, the process of compensating for aging of an LED backlight will be described with reference to FIG. 5.

Figure 5:
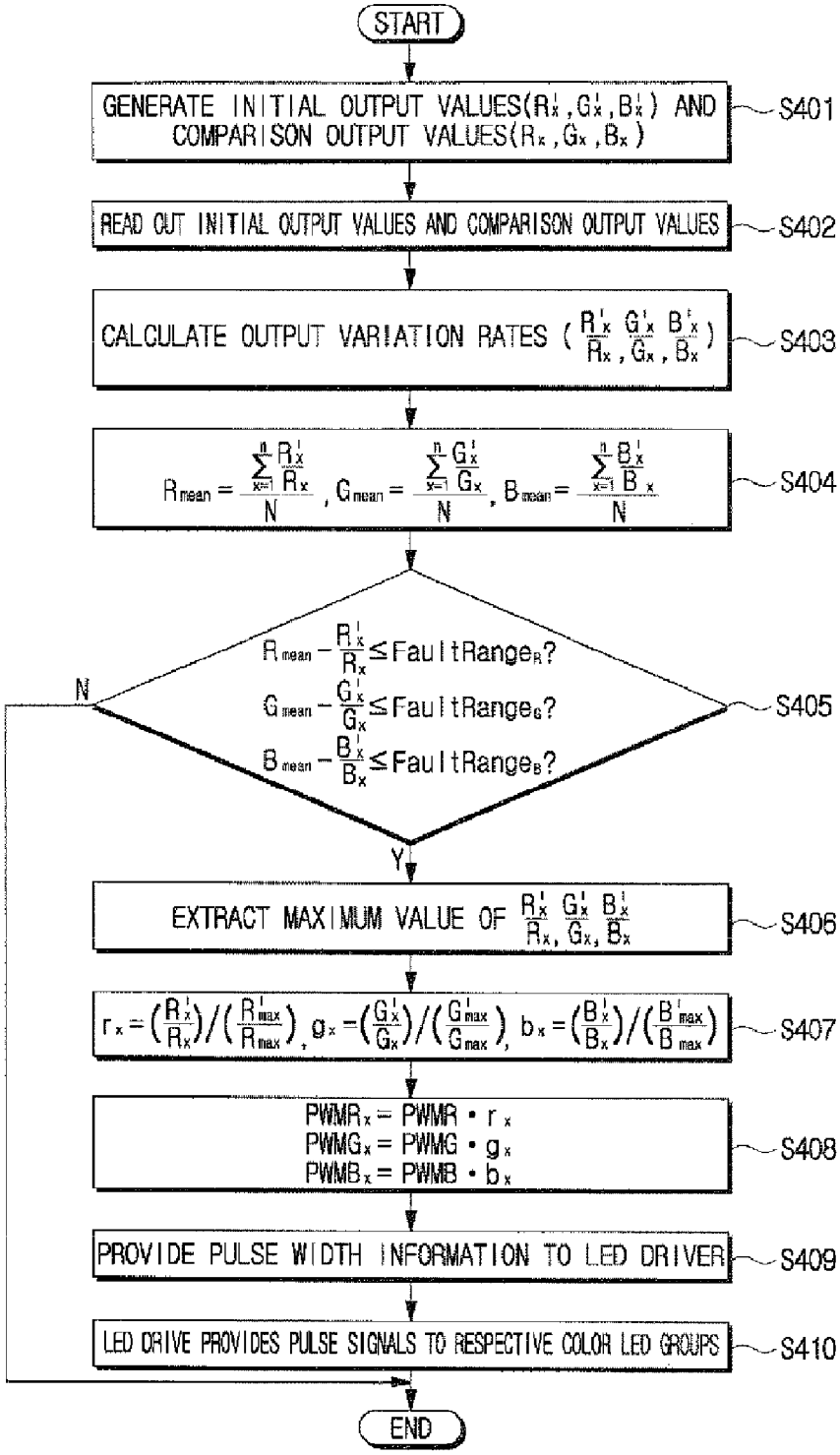
FIG. 5 is a flowchart illustrating a process of compensating for aging of an LED-based optical system according to an exemplary embodiment of the present invention.

First, as illustrated in FIG. 5, the output sense control unit 31 senses the initial output values ($R'_x$,$G'_x$,$B'_x$) of the color LED groups 11, 12, and 13 of the LED blocks 10-1 to 10-N using the RGB sensor 50, and stores the sensed initial output values ($R'_x$,$G'_x$,$B'_x$) in the initial value storage part 41 of the storage unit 40. If the time point for performing the aging compensation process has arrived, the output sense control unit 31 senses the comparison output values ($R_x$,$G_x$,$B_x$) of the color LED groups 11, 12, and 13 of the LED blocks 10-1 to 10-N, and stores the sensed comparison output values ($R_x$,$G_x$, $B_x$) in the comparison value storage part 42 of the storage unit 40 in operation (S401).

Then, the output variation rate calculation unit 32 reads out the initial output values ($R'_x$,$G'_x$,$B'_x$) and the comparison output values ($R_x$,$G_x$,$B_x$) from the initial value storage part 41 and the comparison value storage part 42 of the storage unit 40 in operation (S402), and calculates the output variation rates $$\left(\frac{R'_x}{R_x}, \frac{G'_x}{G_x}, \frac{B'_x}{B_x}\right)$$

of the color LED groups 11, 12, and 13 of the LED blocks 10-1 to 10-N using the read initial output values ($R'_x$,$G'_x$,$B'_x$) and the comparison output values ($R_x$,$G_x$,$B_x$) in operation (S403). Then, the average calculation unit 33 calculates the average output variation rates ($R_{mean}$, $G_{mean}$, $B_{mean}$) of the color LED groups 11, 12, and 13 by using Equation (1) in operation (S404).

If the output variation rates $$\left(\frac{R'_x}{R_x}, \frac{G'_x}{G_x}, \frac{B'_x}{B_x}\right)$$

and the average output variation rates ($R_{mean}$, $G_{mean}$, $B_{mean}$) are calculated, the compensation judgment unit 34 judges whether the compensation is possible with respect to the color LED groups 11, 12, and 13 of the LED blocks 10-1 to 10-N by using Equation (2) in operation (S405). In this case, with respect to the color LED groups 11, 12, and 13 of the LED blocks 10-1 to 10-N that exceed the predetermined compensation range values, the compensation is not performed and the compensation process is terminated (N in operation (S405)).

In order to determine the compensation rates ($r_x$,$g_x$,$b_x$) of the color LED groups 11, 12, and 13 of the LED blocks 10-1 to 10-N of which the compensation is judged to be possible, the compensation rate calculation unit 35 extracts the maximum values $$\left(\frac{R'_{MAX}}{R_{MAX}}, \frac{G'_{MAX}}{G_{MAX}}, \frac{B'_{MAX}}{B_{MAX}}\right)$$

in accordance with the respective colors of the output variation rates $$\left(\frac{R'_x}{R_x}, \frac{G'_x}{G_x}, \frac{B'_x}{B_x}\right)$$

in operation (S406), and calculates the rate of the maximum values $$\left(\frac{R'_{MAX}}{R_{MAX}}, \frac{G'_{MAX}}{G_{MAX}}, \frac{B'_{MAX}}{B_{MAX}}\right)$$

extracted using Equation (3) to the output variation rates $$\left(\frac{R'_x}{R_x}, \frac{G'_x}{G_x}, \frac{B'_x}{B_x}\right)$$

as the compensation rates ($r_x$,$g_x$,$b_x$) of the color LED groups 11, 12, and 13 of the LED blocks 10-1 to 10-N in operation (S407).

Then, the pulse width calculation unit 36 determines the pulse widths of the pulse signals for controlling the amount of current being supplied to the color LED groups 11, 12, and 13 of the LED blocks 10-1 to 10-N by converting the compensation rates ($r_x$,$g_x$,$b_x$) into the pulse widths of the pulse signals in operation (S408).

Information on the determined pulse widths of the pulse signals is provided to the LED driver 20 in operation (S409), and the LED driver 20 controls the amount of current supplied to the corresponding color LED groups 11, 12, and 13 of the LED block 10-1 to 10-N by providing the pulse signals corresponding to the provided pulse widths to the color LED groups 11, 12, and 13 of the LED block 10-1 to 10-N in operation (S410).

At this time, since the compensation rates ($r_x$,$g_x$,$b_x$) are larger than "1", the pulse widths of the pulse signals provided to the color LED groups 11, 12, and 13 of the LED blocks 10-1 to 10-N of which the compensation is performed become narrow in comparison to the existing ones, and thus, the amount of current being supplied to the LED blocks becomes smaller than the existing one.

As described above, according to the method of compensating for aging of an LED-based optical system of this exemplary embodiment of the present invention, the degree of aging of the color LED groups of the LED blocks is judged using the output differences among the respective LED blocks, and a relative large amount of current is supplied to the aged LED group in comparison to other LED groups. Accordingly, the non-uniformity of colors among the LED blocks occurring due to the aging may be removed, and thus, the picture quality is improved with the user's satisfaction sought.

The foregoing exemplary embodiments are merely exemplary and are not to be construed as limiting the present invention. The present teaching can be readily applied to other types of apparatuses. Also, the description of the exemplary embodiments of the present invention are intended to be illustrative, and not to limit the scope of the claims, and many alternatives, modifications, and variations will be apparent to those skilled in the art.

What is claimed is:

1. An LED-based optical system comprising:

LED blocks each composed of a predetermined number of LEDs;

a sensor which senses output values of the respective LED blocks; and a control block which generates compensation rates based on the sensed output values and controls current being supplied to the respective LED blocks in accordance with the compensation rates, wherein the compensation rates are generated by comparing initial output values of the respective LED blocks in an initial state with comparison output values of the respective LED blocks sensed by the sensor at a comparison time point.

2. The LED-based optical system of claim 1, wherein the control block comprises:

an output variation rate calculation unit which outputs output variation rates which are ratios of the initial output values to the comparison output values for the respective LED blocks; and a compensation rate calculation unit which extracts a maximum value among the output variation rates of the respective LED blocks, and calculates the compensation rates by dividing the output variation rates of the respective LED blocks by the maximum value.

3. The LED-based optical system of claim 2, wherein the output variation rates are calculated with respect to each of red (R) color LED group, green (G) color LED group, and blue (B) color LED group included in the respective LED blocks.

4. The LED-based optical system of claim 3, wherein the control block comprises an average calculation unit which calculates average output variation rates for each of the R, the B and the G color LED groups by averaging the output variation rates of the respective color LED groups.

5. The LED-based optical system of claim 4, wherein the control block further comprises a compensation judgment unit which judges whether output compensation for respective R, B and G color LED groups of the LED blocks is carried out in accordance with differences between the average output variation rates of the respective R, B and G color LED groups and the output variation rates of the respective R, B and G color LED groups of the LED blocks.

6. The LED-based optical system of claim 5, wherein the compensation judgment unit judges that the respective R, B and G color LED groups of a corresponding color have been damaged or a measurement error has occurred if a corresponding one of differences exceeds a threshold value, wherein the compensation judgment unit judges that the compensation is impossible if the corresponding one of differences exceeds the threshold value.

7. The LED-based optical system of claim 3, wherein the compensation rate calculation unit extracts a maximum value among the output variation rates for each color, and calculates the compensation rates of the respective R, B and G color LED groups of the LED blocks by dividing the output variation rates of the respective R, B and G color LED groups of the LED blocks by the maximum value.

8. The LED-based optical system of claim 7, wherein the control block further comprises a pulse width calculation unit which calculates pulse widths to be applied by multiplying pulse widths of pulse signals, which have been previously provided with respect to the respective R, B and G color LED groups of the LED blocks by the compensation rates.

9. The LED-based optical system of claim 8, further comprising an LED driver which controls the respective R, B and G color LED groups of the LED blocks;

wherein the control block provides information on the calculated pulse widths to the LED driver, and the LED driver provides pulse signals having the calculated pulse widths to the respective R, B and G color LED groups of the LED blocks.

10. The LED-based optical system of claim 3, wherein the sensor comprises R, G, and B sensors to sense outputs of the R, the G, and the B color LED groups.

11. The LED-based optical system of claim 10, wherein the R, G, and B sensors are separate units.

12. The LED-based optical system of claim 11, wherein the R, G, and B sensors have adjustable sensitivities.

13. The LED-based optical system of claim 10, wherein a plurality of sensor groups each having the R, the G, and the B sensors are installed.

14. The LED-based optical system of claim 13, wherein the R sensors, the G sensors, and the B sensors are configure to have different sensitivities in respective sensors of a same color.

15. The LED-based optical system of claim 10, wherein a plurality of sensor groups each having the R, the G, and the B sensors are installed at predetermined intervals.

16. The LED-based optical system of claim 15, wherein the sensor groups have a same sensitivity.

17. The LED-based optical system of claim 16, wherein if the initial output values or the comparison output values of the respective LED blocks are sensed, the R, the G, and the B color LED groups included in the LED blocks are each energized alternately.

18. The LED-based optical system of claim 1, wherein if the initial output values or the comparison output values of the respective LED blocks are sensed, the R, the G, and the B color LED groups included in the LED blocks are energized at simultaneously.

19. The LED-based optical system of claim 18, wherein if the initial output values or the comparison output values of the respective LED blocks are sensed, the respective LED blocks are sensed one by one by alternately energizing the LED blocks.

20. A method of compensating for aging of an LED-based optical system, comprising:

generating initial output values of LED blocks each composed of a predetermined number of LEDs in an initial state;

generating comparison output values of the LED blocks by sensing output values of the LED blocks at a comparison time point;

generating specified compensation rates by comparing the initial output values with the comparison output values; and compensating outputs of the LED blocks based on the specified compensation rates.

21. The method of claim 20, wherein the generating the specified compensation rates comprises:

calculating output variation rates which are ratios of the initial output values to the comparison output values for the LED block;

extracting a maximum value among the output variation rates; and calculating the compensation rates by dividing the output variation rates of the LED blocks by the maximum value.

22. The method of claim 21, wherein the calculating the output variation rates comprises calculating an output variation rate for with respect to respective colors including a red (R), a green (G), and a blue (B) LED group in the LED blocks.

23. The method of claim 22, wherein the generating the specified compensation rates further comprises calculating average output variation rates of the respective colors by averaging the output variation rate of each respective color.

24. The method of claim 23, further comprising judging whether output compensation for the color LED groups of the LED blocks is possible in accordance with differences between the average output variation rates of the respective colors and the output variation rates of the color LED groups of the LED blocks.

25. The method of claim 24, further comprising judging that the LED groups of the corresponding color have been damaged or a measurement error has occurred if the differences exceeds a threshold value, wherein it is judged that the compensation is impossible if the differences exceeds the threshold value.

26. The method of claim 25, wherein the extracting the maximum value comprises extracting a maximum value for each color from the output variation rates, and the calculating the compensation rates comprises calculating the compensation rates by dividing the output variation rates of the respective color LED groups of the LED blocks by the maximum value.

27. The method of claim 26, wherein the compensating the outputs further comprises calculating pulse widths to be applied by multiplying pulse widths of pulse signals, which have been previously provided with respect to the color LED groups of the LED blocks by the compensation rates.

28. The method of claim 27, further comprising providing the pulse signal having the pulse widths to the respective color LED groups of the LED blocks.

29. The method of claim 20, wherein when the initial output values or the comparison output values of the respective LED blocks are sensed, the respective LED blocks are sensed one by one by alternately energizing the respective LED blocks.

30. The method of claim 29, wherein when the initial output values or the comparison output values of the respective LED blocks are sensed, the R, the G, and the B color LED groups included in the LED blocks are alternately energized.

31. The method of claim 29, wherein when the initial output values or the comparison output values of the respective LED blocks are sensed, the R, the G, and the B LED groups included in the LED blocks are energized simultaneously.

* * * * *